US006070524A

United States Patent [19]

Marroquin-Garza et al.

[11] Patent Number: 6,070,524

[45] **Date of Patent: *Jun. 6, 2000**

[54] PROCESS AND MACHINE FOR DECORATING CONTAINERS OR SIMILAR ARTICLES

[75] Inventors: Elio Marroquin-Garza; Carlos Guerra-Garza, both of Nuevo Leon, Mexico

[73] Assignee: Vidriera Monterrey, S.A. de C.V., Nuevo Leon, Mexico

[ * ] Notice: This patent issued on a continued prosecution application filed under 37 CFR 1.53(d), and is subject to the twenty year patent term provisions of 35 U.S.C. 154(a)(2).

[21] Appl. No.: 08/973,347

[22] PCT Filed: May 31, 1996

[86] PCT No.: PCT/MX96/00006

§ 371 Date: Dec. 1, 1997

§ 102(e) Date: Dec. 1, 1997

[87] PCT Pub. No.: WO96/38305

PCT Pub. Date: Dec. 5, 1996

[30] Foreign Application Priority Data

Jun. 1, 1995 [MX] Mexico ..... 952448

[51] Int. Cl.[7] ..... B41F 17/14

[52] U.S. Cl. ..... 101/129; 101/126; 101/40.1

[58] Field of Search ..... 101/115, 123, 101/124, 126, 129, 38.1, 40.1

[56] References Cited

U.S. PATENT DOCUMENTS

| | | | |
|---|---|---|---|
| 3,180,252 | 4/1965 | Fuerst | 101/126 |
| 3,277,816 | 10/1966 | Olsen | 101/115 |
| 3,783,777 | 1/1974 | Killen et al. | 101/126 |
| 3,842,733 | 10/1974 | Dubuit | 101/115 |
| 4,380,955 | 4/1983 | Okura | 101/115 |
| 5,317,967 | 6/1994 | Heidenreich | 101/38.1 |

FOREIGN PATENT DOCUMENTS

| | | | |
|---|---|---|---|
| 0727309 | 8/1996 | European Pat. Off. . | |
| 2239344 | 2/1975 | France . | |
| 1571842 | 2/1971 | Germany . | |
| 2742245 | 3/1979 | Germany . | |
| 458013 | 12/1936 | United Kingdom | 101/124 |

*Primary Examiner*—John S. Hilten
*Assistant Examiner*—Amanda B. Sandusky
*Attorney, Agent, or Firm*—Abelman, Frayne & Schwab

[57] ABSTRACT

The present invention is referred to a method and a machine for decorating bottles or similar articles of the type that includes: a supporting structure; a rotatable shaft (12) coupled in the supporting structure, to rotate over its own axis with an intermittent movement; a plurality of transporting stations (14) connected to the shaft (12) to rotate together with the rotatable shaft (12); supporting members (16 and 18) for each transporting station (14), each supporting member (16, 18) being arranged to transport a bottle from a loading position to an unloading position of the machine; drive means connected to the rotatable shaft (12), the rotatable shaft (12) and the transporting stations (14) being rotated together by means of the drive means; and, a printer screen (PD) for each of the transporting stations (14), the screens (PD) being located toward and coinciding with a surface of the bottles to be decorated, the machine having at least two free transporting stations (14), one for the loading and another one for the unloading of the bottles to the machine, wherein the supporting members (16, 18) comprising elements for supporting at least two bottles (A, B) for each of the transporting stations (14), said supporting members (16, 18) being positioned for each one of the screens (PD) in order to simultaneously print at least two bottles (A, B) with one or various designs or patterns through of a single printer screen (PD).

2 Claims, 8 Drawing Sheets

PROCESS AND MACHINE FOR DECORATING CONTAINERS OR SIMILAR ARTICLES

CROSS REFERENCE TO RELATED APPLICATIONS

This application is the National Stage of International Application No. PCT/MX96/00006, filed May 31, 1996.

BACKGROUND OF THE INVENTION

For the decorating of glass articles with paint, such as bottles, jars and similar articles, it is necessary to take them to the loading station of a decorating machine where these articles are clamped and transferred to one or two decorating stations and finally, once these articles have been decorated, are transported to an lehr, so the paint, by means of heat, will adhere to the recently decorated articles.

One of the better known techniques for bottle or jar decoration is the screen process. In this process, the bottles or jars are transported by their ends to a decorating machine that includes a paint reservoir with a screen or stencil in the lower section. Each screen includes a decorating pattern in accordance to the design that one desires to print on the container.

By means of this process, once the bottle is set up in horizontal position in the first printing station of the decorating machine, it is rotated on supporting members located on the top and bottom ends of the bottle, it is moved towards a printing frame that has a decorating screen. The support members are arranged opposite one to the other leaving a space between them to receive the bottle. A squeegee or applicator on the upper part of the printing frame presses the decorating screen assuring that the paint is applied correctly on the profile or section desired on the bottle when this is rotated over the screen.

One of the main decorating machines of the previous art, is generally made up of a support structure, a driving shaft set horizontally between the supporting structure, the shaft having integrated a series of transporting stations which receive only a bottle to be decorated and pass this intermittently toward decorating stations. One decorating screen set horizontally over one of the transporting stations makes contact with the surface of the bottle during the decorating stage. Such screen has a sliding movement from front to back while the bottle rotates over its own axis, thus decorating by means of such movements the desired section of the bottle.

In case of decorating two bottles, the machine has two screens, set parallel with respect to the surface of the container, such screens being separated a certain distance one in front of the other. Because the decorating machine has at least six transporting stations, each station moves one single article to be decorated. Nevertheless, due to the fact that the transportation stations have a rotating movement on their own axis, in the sequence of movement of the stations, the first article is decorated by the front screen (second screen) while the second article makes contact with the back screen (first screen). Such movement allows two stations to decorate simultaneously two bottles with the same decorating pattern.

Notwithstanding the previous description, one of the main disadvantages of the type of decorating machines described above, is that the articles are only decorated with a single color. Thus, in case the bottle or article requires two or more colors, it is necessary to pass the recently decorated bottles again to the decorating machine to print the next or several decorating colors.

In order to avoid the disadvantages of the previous art, the U.S. Pat. No. 3,735,699 issued to Albert Koelschbach, describes a multicolor offset screen printing apparatus for producing a multi-color image on an object, by means of the known silk screen process, wherein there are a number of silk screens each with its own decorating pattern, the number of screens being equal to the number of colors to be employed. The decorative print is applied by a contact blade to an associated silk screen. An intermediate color carrier such as a belt or a plurality of rollers receives a colored image from each screen and applies the colored image in sequence to an article by rolling contact between the article and the intermediate belt or rollers.

Nevertheless, even if the Koelschbach machine has the capacity of decorating two or more colors in one sequence, one of the disadvantages of such machine is that the decorating of the articles is in individual form, that is, only one article per station, thus the process is slow, due mainly to the fact that today they are manufactured in greater quantities and it is required to decorate a greater quantity of glass or similar articles.

Other apparatuses for printing objects are described in the Patents No. DE 1571842; U.S. Pat. No. 3,783,777; and FR 2239344. For example, is Patent DE 1571842 is refers to a machine for decorating bottles or similar articles of the type that includes: a supporting structure; a rotatable shaft coupled in the supporting structure, to rotate over its own axis with an intermittent movement; a plurality of transporting stations connected to said shaft to rotate together with said drive shaft; supporting members for each transporting station, each supporting member being arranged to transport a cylindrical article as for example from a loading position to an unloading position of the machine; drive means connected to the rotatable shaft, said rotatable shaft and said transporting stations being rotated together by means of the drive means, and a printer screen for each two transporting stations, said screen being located towards and coinciding with a surface of the bottles to be decorated wherein the supporting members comprise means for supporting a cylindrical article for each of the transporting stations. Said supporting member is positioned for each one of the printing screens in order to simultaneously print at least two bottles—one for each of the transporting stations—with a color and a single printer screen.

However, patent No. DE 1571842 refers to a machine for decorating bottles, which is arranged to transport a cylindrical article for each station and uses a printer screen for each two transporting stations. The main problem of this machine is that each bottle is supported in an independent station, so that, a large printer screen is required to decorate simultaneously two bottles. With this arrangement, it is not possible decorate two articles or bottles simultaneously in a sole station. Neither is it possible to decorate at least two bottles, with three different to decorate screens or decorating at least two bottles with four different decorating screens.

U.S. Pat. No. 3,783,777 dated on Jan. 8, 1974, of Richard J. Killen, also claims an apparatus for imprinting objects such as bottles or the like. Said apparatus comprises a main conveyor including a drive shaft and, a series of article carriers connected to the conveyor for advancement thereby along a path toward a printing station. Flanking opposite straight sides of the conveyor are first and second assemblies, which are individually movable on guides along the opposite sides of the bottle conveyor. The assemblies support identical squeegee conveyors, respectively. Carried with the squeegee conveyors are identical tiltable stencil screens, respectively. Thus, the movable assemblies each include an inside tiltable stencil screen, an outside color container to provide a color pool, and a squeegee conveyor for carrying color from its pool to its stencil screen, each squeegee conveyor being adjustably mounted upon its carriage.

However one of the first disadvantages of this apparatus is that, for printing three or more colors on the containers, it is necessary to add more squeegee conveyors through the length of the apparatus.

Finally, the patent FR-A-2 239 344 discloses a dispositive or device for printing caps or similar articles. The first part of the specification is described to print caps are over its top part (see FIGS. 1–3). In this first embodiment, it is necessary to maintain the cap or caps fixed and retained in one of its extremities.

In a second embodiment of the French patent, the device is described for decorating bottles. However it is only possible to print a bottle for one printing station. In this case the bottles are feeding—one by one—by means of the transporting stations toward each one of the printing stations.

In view of the above, the present invention refers to a method and a machine for decorating bottles or similar articles of the type that includes: a supporting structure; a rotatable shaft coupled in the supporting structure, to rotate over its own axis with an intermittent movement; a plurality of transporting stations connected to said shaft to rotate together with said rotatable shaft, each transporting station having an individual supporting member, which are arranged in a position one in front of the other, leaving a space between each other to hold a container by its neck and bottom respectively, to transport the container from a loading position to an unloading position of the machine; drive means connected to the rotatable shaft, said rotatable shaft and said transporting stations being rotated together by means of the drive means; and, a printer screen for each one of the transporting stations, said printer screens being located toward and coinciding with a surface of the container to be decorated, the improvements characterized by comprising: at least two holding means for each one of the supporting members, for holding of the bottom of at least two containers; and, at least two holding means for each one of the supporting members, for holding the neck of at least said two containers, said holding means being arranged symmetrically in order that said two containers can be printed with a single printer screen for each printing station, each printer screen being adjusted parallel or angularly with respect to the surface of the containers in order to decorate simultaneously at least said two containers during each printing stage.

OBJECTIVES OF THE INVENTION

It is a first objective of the present invention, to provide a method and a machine for decorating bottles or similar articles, that can decorate at least two bottles per station with the same decorating pattern.

An additional objective of the present invention, is to provide a method and a machine for decorating bottles or similar articles that can decorate simultaneously in one process at least two articles with two, three or four decorating screens.

Another objective of the present invention is to provide a method and a machine for decorating bottles or similar articles that increases the productivity of the decorating machines.

These and other objectives and additional advantages of the present invention, will be evident to the expert in the field based on the following detailed description of the invention, that will be made with reference to the various specific embodiments of the same in an illustrative sense but not in a limiting sense with respect to the invention.

DETAILED DESCRIPTION OF THE INVENTION

Figure 1:
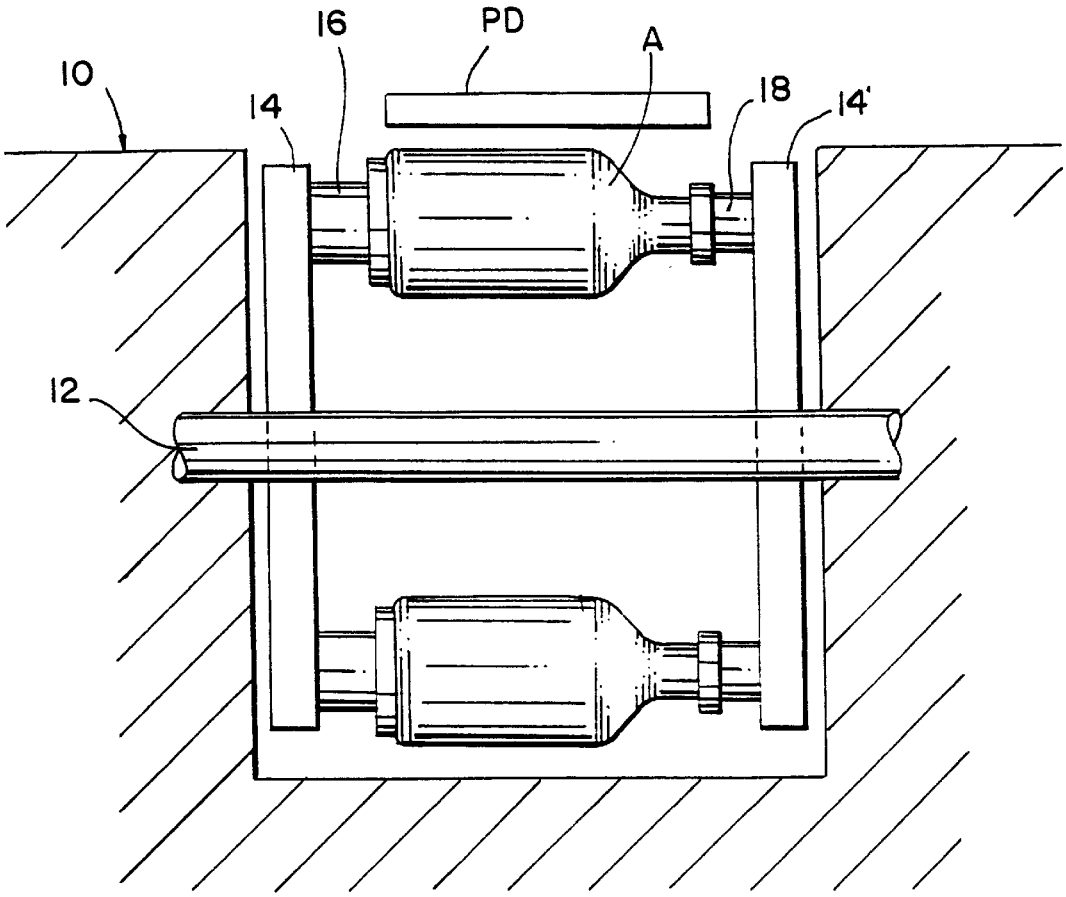
FIG. 1 is a side view of a section of a screen decorating machine, showing in schematic form the position of a bottle with respect to a decorating screen.

Reference is made to each of the several embodiments of the present invention, which are illustrated in the figures that are attached and where the same numbers makes reference to the same parts and where FIG. 1 shows a lateral section, in schematic form of a screen decorating machine 10. Such machine includes a supporting structure (not shown). The supporting structure has a rotatable shaft 12, located in a horizontal position, that rotates over its own axis with an intermittent movement. A plurality of transporting stations 14, 14', are connected to rotate together with such rotatable shaft 12. Such stations 14, 14', have a pair of supporting members 16, 18, arranged in a position one in front of the other leaving a space between to support the base and the top of the bottle respectively. Each supporting member 16, 18 is arranged to transport two or more bottles for decoration (see FIGS. 2 to 5 ) from a loading position to an unloading position. Such supporting members 16, 18 act as holding devices to hold or free the bottles during the decorating process.

A drive system (not shown) connected to the rotatable shaft 12, rotates such shaft 12 and with it the different transporting stations 14, and at least a decorating screen PD for each of the transporting stations 14. Said screens PD are placed parallel or in angle with respect to the surface of the bottles to be decorated, which by means of the longitudinal movement (forward and backward) decorate simultaneously at least two articles with at least two different decorating screens. The screens PD are also moved transversely with respect to the surface of the bottle to be decorated (forward to locate the screen in position to decorate the bottle, or backward to remove the screen from the decorating process). Such machine has at least one free transporting station (14*a*) for loading and another for unloading (14*f*) the articles from the machine.

As shown in FIGS. 2 to 5, the decorating machine 10 shows six transporting stations 14 (14*a*, 14*b*, 14*c*, 14*d*, 14*e*, 14*f*) that are connected to rotate together with the rotatable shaft 12 with a variable and intermittent speed. One of four decorating screens 20, 22, 24 and 26 are located in coincidence and above each of the transport stations 14*b*, 14*c*, 14*d* and 14*e*. Such screens 20, 22, 24 and 26 are located in a parallel position with respect to the surface to be decorated in the bottle A ( FIG. 1) which is located between the supporting members 16, 18. In accordance with the schematic diagrams illustrated in FIGS. 2 to 5, the transporting station 14*a* receives bottles A and B—it also can receive only a bottle A (see FIG. 5)—by means of a loading mechanism (not shown) from a conveyor 28. Such bottles (A, B) are taken throughout the different decorating screens 20, 22, 24 and 26 for the simultaneous decoration of one or more patterns and finally are unloaded in the position of transporting station 14*f*. The articles recently decorated are transported in an unloading conveyor toward a packing area (not shown).

Figure 2:
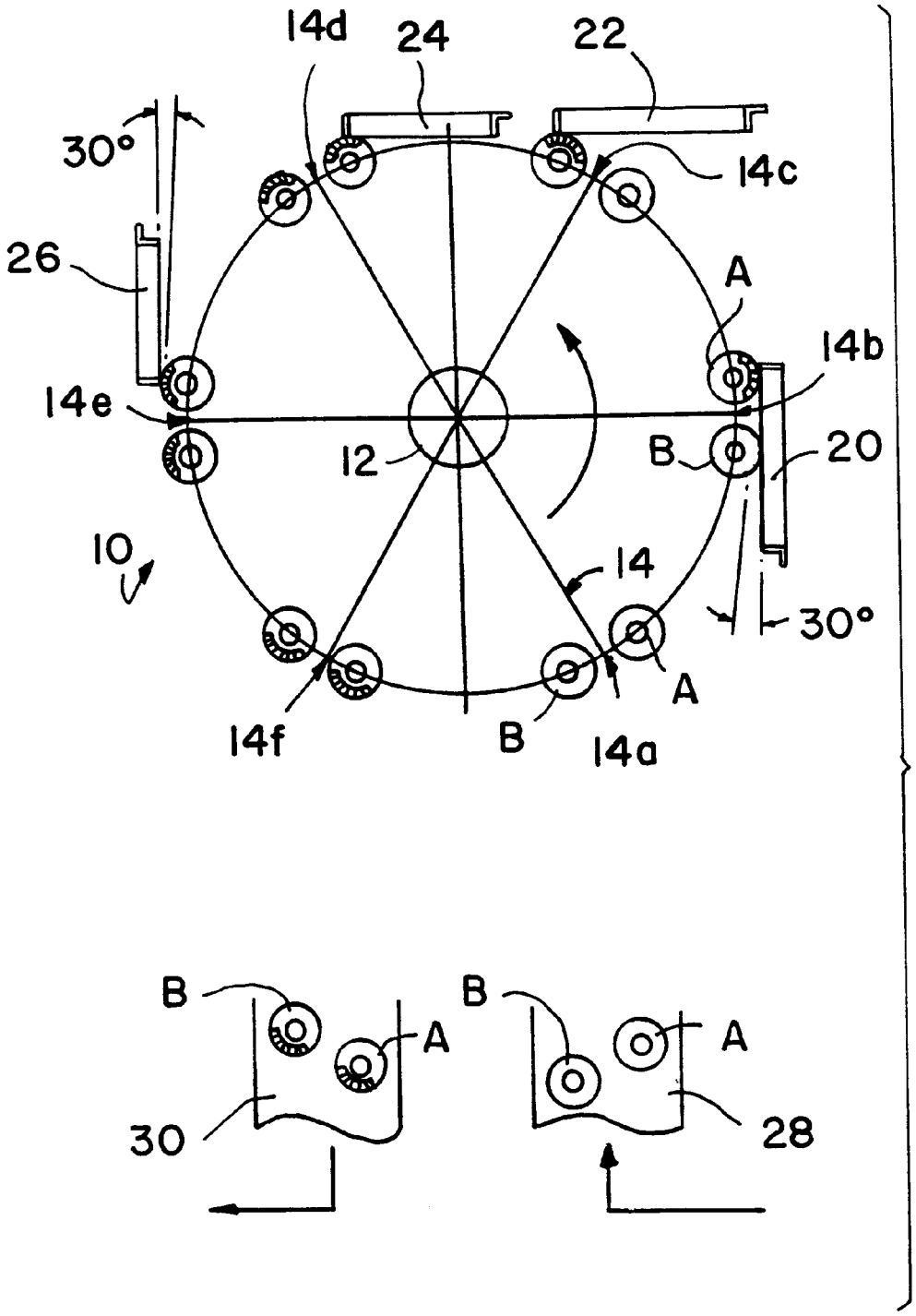
FIG. 2 represents a schematic diagram of a first embodiment of a decorating machine in accordance with the present invention, for the decorating of two bottles with two different colors.

Making reference in particular to FIG. 2, a first embodiment is shown of the decorating machine 10 to decorate the two bottles A and B in a simultaneous manner with two different pattern screens. As can be seen in the arrangement, the screens 20 and 26, are located at an angular position (with an approximate inclination of 30°) with respect to the position of the transporting stations 14*b* and 14*e*. The screen 20 shows an inclination outwards (avoiding contact with the bottle B) and the screen 26 shows an inclination with an inward angle (avoiding contact with bottle A). Screens 22 and 24 are located in a horizontal position with respect to the rotating path of the stations 14*c* and 14*d*. Such screens 20, 22, 24 and 26 have a forward and backward sliding movement while the bottles A and B rotate over the supporting members 16, 18 decorating by means of such movements the desired sections of the bottles.

The decoration of two bottles A and B with two different decorating screens, in the embodiment above described is carried out as follows: two bottles are received from the conveyor 28 and are loaded in the corresponding position on transporting stations 14*a*. The bottles A and B are taken with an intermittent movement toward the position 14*b*, in which the decorating screen 20 applies a first decoration (exclusively to the bottle A) while bottle B continues its travel toward the following station, without decoration. In the corresponding position to station 14*c* and screen 22, the decoration of the bottle A is finished, while bottle B continues without decoration. In the position corresponding to station 14*d* and decorating screen 24, the decoration of bottle B starts with the first stage of decoration, ending the second decorating pattern in the corresponding position of station 14*e* and decorating screen 26. On these last two positions 14*d* and 14*e*, bottle A only travels in the same path with bottle B but does not receive any more decoration. Finally both bottles A and B, being recently decorated, are unloaded in the corresponding position of transporting station 14*f* to the unloading conveyor 30.

In the second embodiment of the present invention (FIG. 3) an arrangement of the decorating machine 10 is shown to carry out the simultaneous decoration of two bottles A and B with three different colors. As can be seen in this arrangement, screens 20, 26 are set up in a parallel position to the trajectory of the two bottles A and B. That is, screens 20 and 26 make direct contact with both bottles A and B at the same time. In this embodiment, screens 22 and 24 maintain the horizontal position with respect to the trajectory of stations 14*c* and 14*d*. These screens 20, 22, 24 and 26 have a back and forth sliding movement, while bottles A and B rotate over the supporting members 16 and 18 decorating by means of such movements the desired section of the bottle.

The simultaneous decoration of two bottles A and B with three different decorating screens is done as follows. Bottles A and B are received from the belt conveyor 28 and loaded in the corresponding position in the transporting station 14*a*. Bottles A and B are taken with an intermittent movement toward position 14*b*, where decorating screen 20 applies a first decoration simultaneously to the surface of both bottles A and B. In the position corresponding to station 14*c* and screen 22, a second decoration is applied exclusively to bottle A, while bottle B is not decorated. In the position corresponding to station 14*d* and decorating screen 24, a second decoration is applied exclusively to bottle B (the bottle A does not receive any decoration in this station). In the position corresponding to stage 14*e*, both bottles A and B receive simultaneously a third decoration by means of printer screen 26. Finally both bottles A and B, recently decorated with three colors are unloaded in the position corresponding to transport station 14*f* in the belt conveyor 30.

Figure 4:
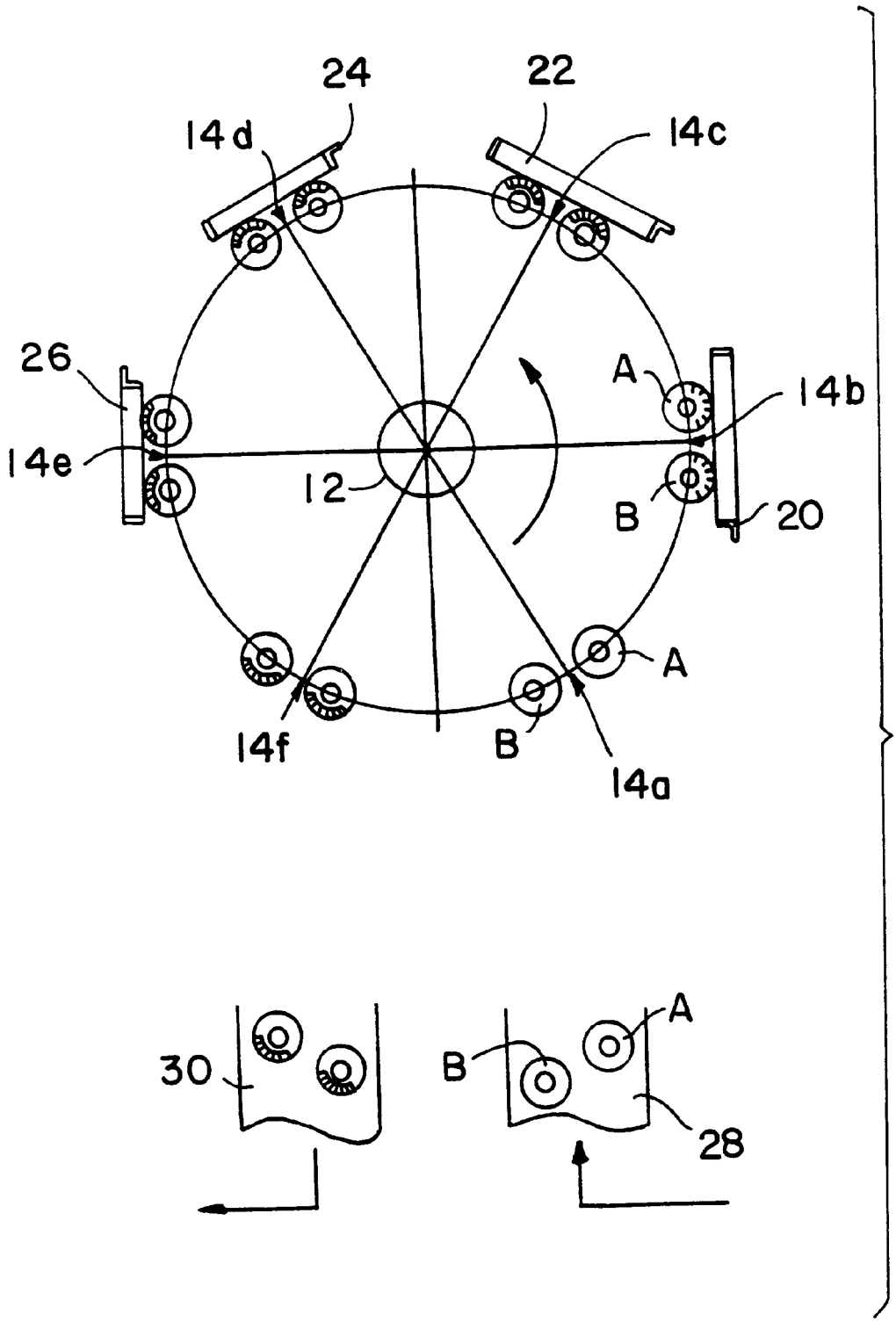
FIG. 4 represents a schematic diagram of a third embodiment of the decorating machine in accordance with the FIG. 2 for the simultaneous decoration of two bottles with four different colors.

Referring now to FIG. 4, there is shown a schematic diagram of the fourth embodiment of the decorating machine 10 for the simultaneous decoration of two bottles A and B with four different colors. In this embodiment, the screens 20, 22, 24 and 26 are located parallel and coinciding with respect to the surface to be decorated in both bottles A and B, in the various stations of the machine. That is, now screens 20, 22, 24 and 26 make direct contact with both bottles A and B, printing a different color at each of the stations 14*b*, 14*c*, 14*d* and 14*e* (four different colors).

The decorating of two bottles A and B with four decorating screens is done as follows: Two bottles are received from the belt conveyor 28 and loaded in the position corresponding to transporting station 14*a*. Bottles A and B are taken with an intermittent movement toward position 14*b*, where decorating screen 20 applies a first color directly over bottles A and B. In the position corresponding to stations 14*c* and decorating screen 22, a second color is applied to bottles A and B. In the position corresponding to stations 14*d* and decorating screen 24, a third color is applied to bottles A and B and, finally in the position corresponding to stage 14*e*, both bottles A and B receive a fourth color through the screen 26. Finally both bottles A and B recently decorated with four colors are unloaded in the position corresponding to transporting station 14*f* to the belt conveyor 30. Nevertheless, as can be appreciated in this embodiment of the invention, the decorating machine in its continuous movement, can decorate simultaneously up to eight bottles, increasing considerably the productivity of the machine.

Figure 3:
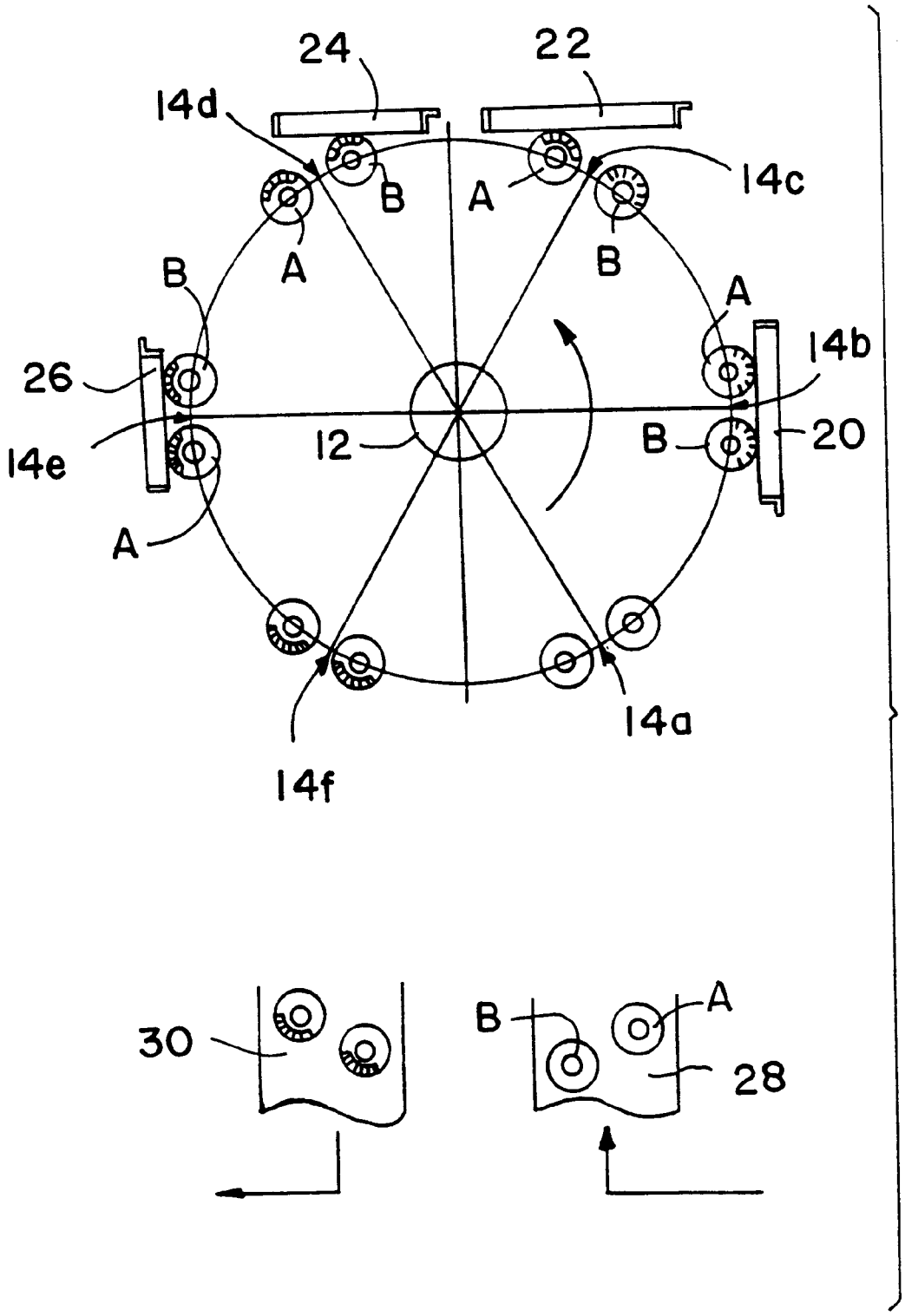
FIG. 3 represents a schematic diagram of a second embodiment of the decorating machine in accordance with the present invention for the simultaneous decoration of two bottles with three different colors.
Figure 5:
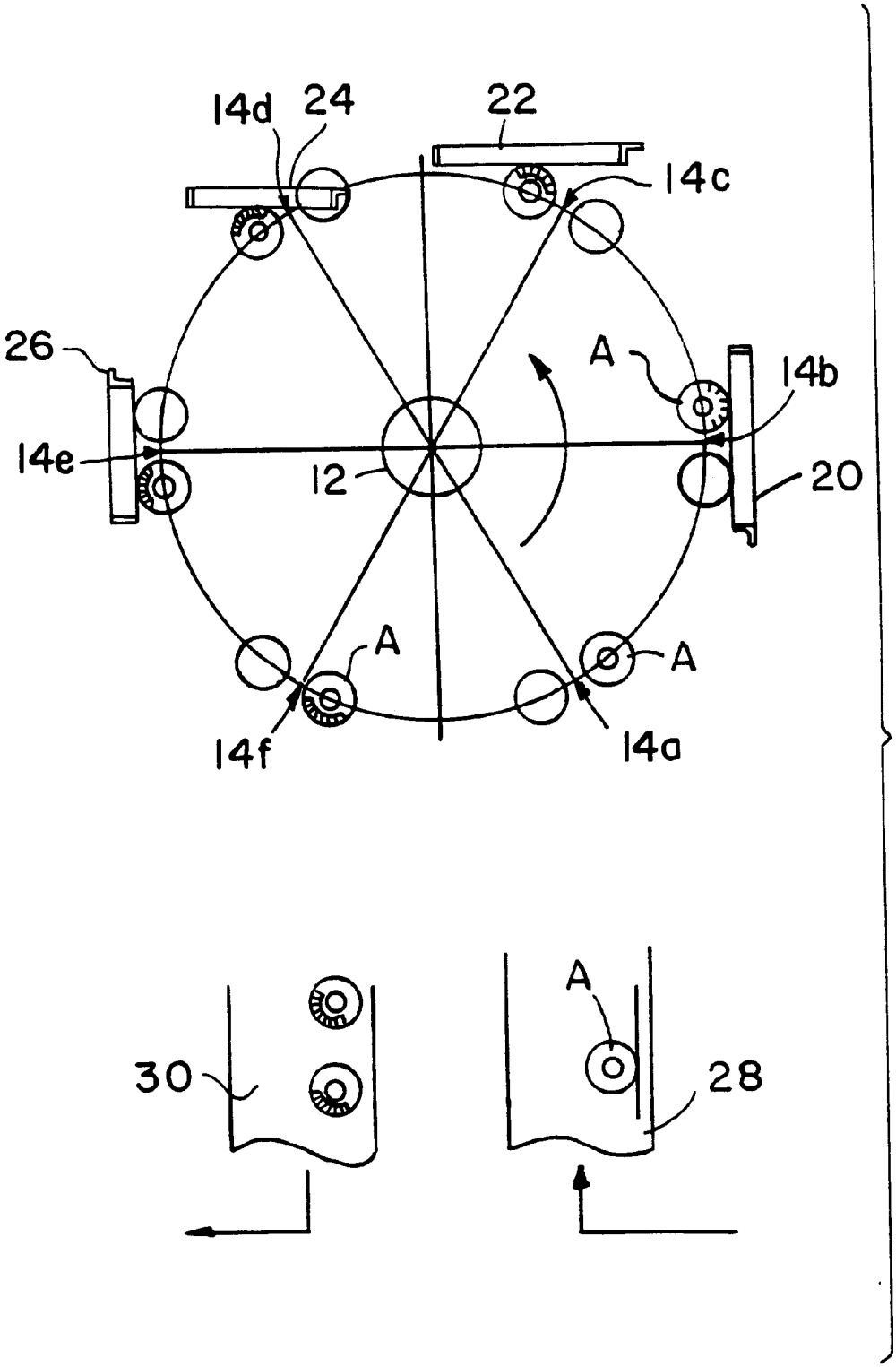
FIG. 5 represent a schematic diagram of a fourth embodiment of the decorating machine in accordance with the present invention for the decoration of one bottle with four different colors.

Finally in a fourth embodiment of the present invention, FIG. 5 shows a similar view as FIG. 3 but applied to decorate one single bottle (A) with four designs or patterns. In this embodiment even when the arrangement of the supporting members 16 and 18 are prepared to transport two bottles, the decorating machine 10 can be fed with one bottle (A) only which is decorated by means of four different colors with screens 20, 22, 24 and 26. In order to perform this operation, it is only necessary to take out of phase the position of screen 24 with respect to screen 22. The operation of the machine is similar to that described before.

Figure 6:
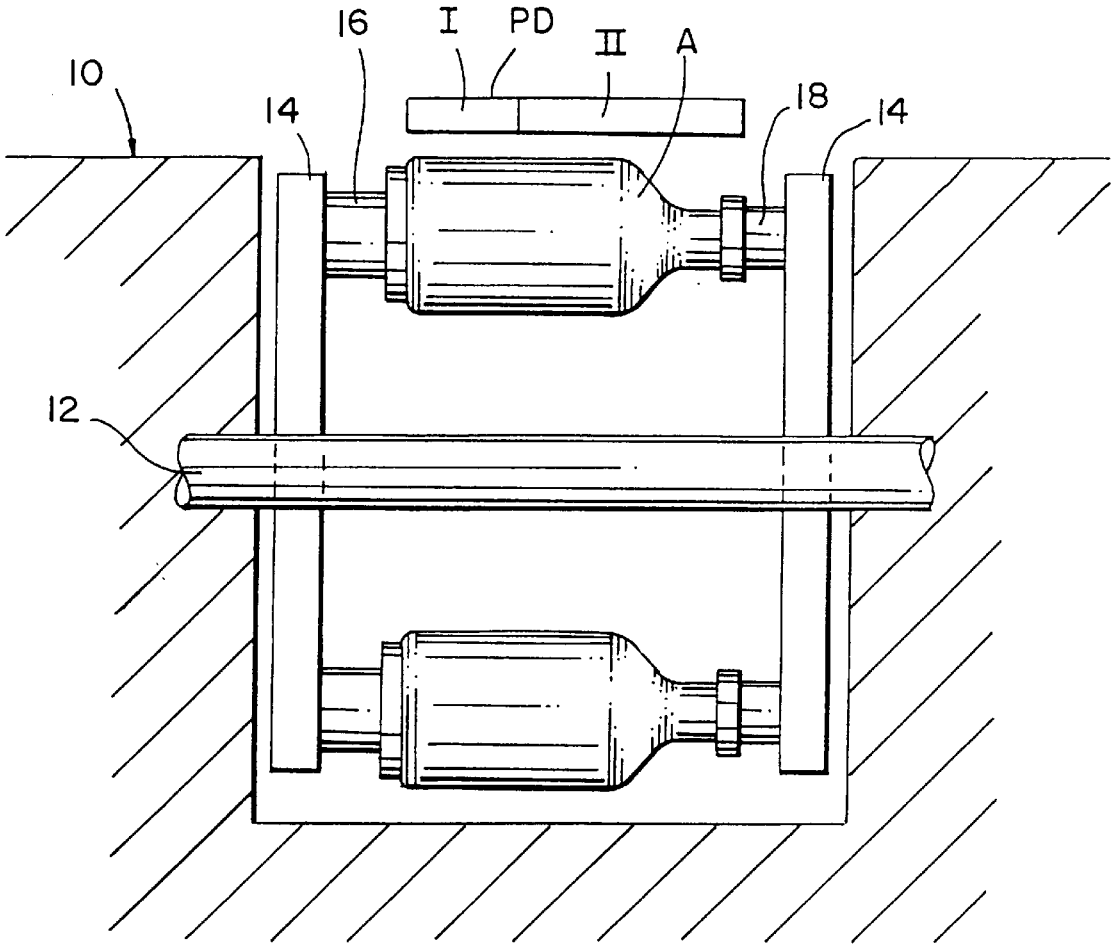
FIG. 6 is a side view of a section of a screen decorating machine showing such decorating screen divided in two or more sections; and, FIGS. 7 and 7A represents a schematic diagram of a screen decorating machine for the simultaneous decoration of bottles of different configuration and different decorating pattern.

Even though a machine for the simultaneous decoration of two bottles per station, with at least two different colors has been described, it is also possible to apply under the same concept, two or three colors per screen in the various sections of the body of the bottle. That is, the screen PD (screens 20, 22, 24 and 26) can be divided into two or more paint containers I and II (FIG. 6) and from each container different designs or patterns of decoration and color may be applied on each section of the bottle. Thus the machine could print a first design or pattern that requires several colors very near the lower part of the bottle and at the same time another pattern with another series of different colors on the central part of the bottle. As an example, we can cite the embodiment illustrated in FIG. 4, by means of this arrangement of containers, it would be possible to handle up to eight different colors with two decorating screens over the bottles (four on each printing).

Also, by means of the transverse movement of the screens (toward contact with the decorating surface and back free of contact with the decorating surface) two different types of bottles can be fed in alternate form, such bottles being decorated with two different colors each. Taking as an example, the system of the present invention illustrated on FIGS. 7 and 7A, the simultaneous decoration of two different types of bottles ( two or more per stations) is performed alternating the position of screens 20, 22, 24 and 26. For example, screens 20 and 24 can be used to decorate the first pair of bottles A and B with the first decorating design or pattern; and, screens 22 and 26 can be used to decorate simultaneously two bottles C and D with another different design or pattern.

Figure 7:
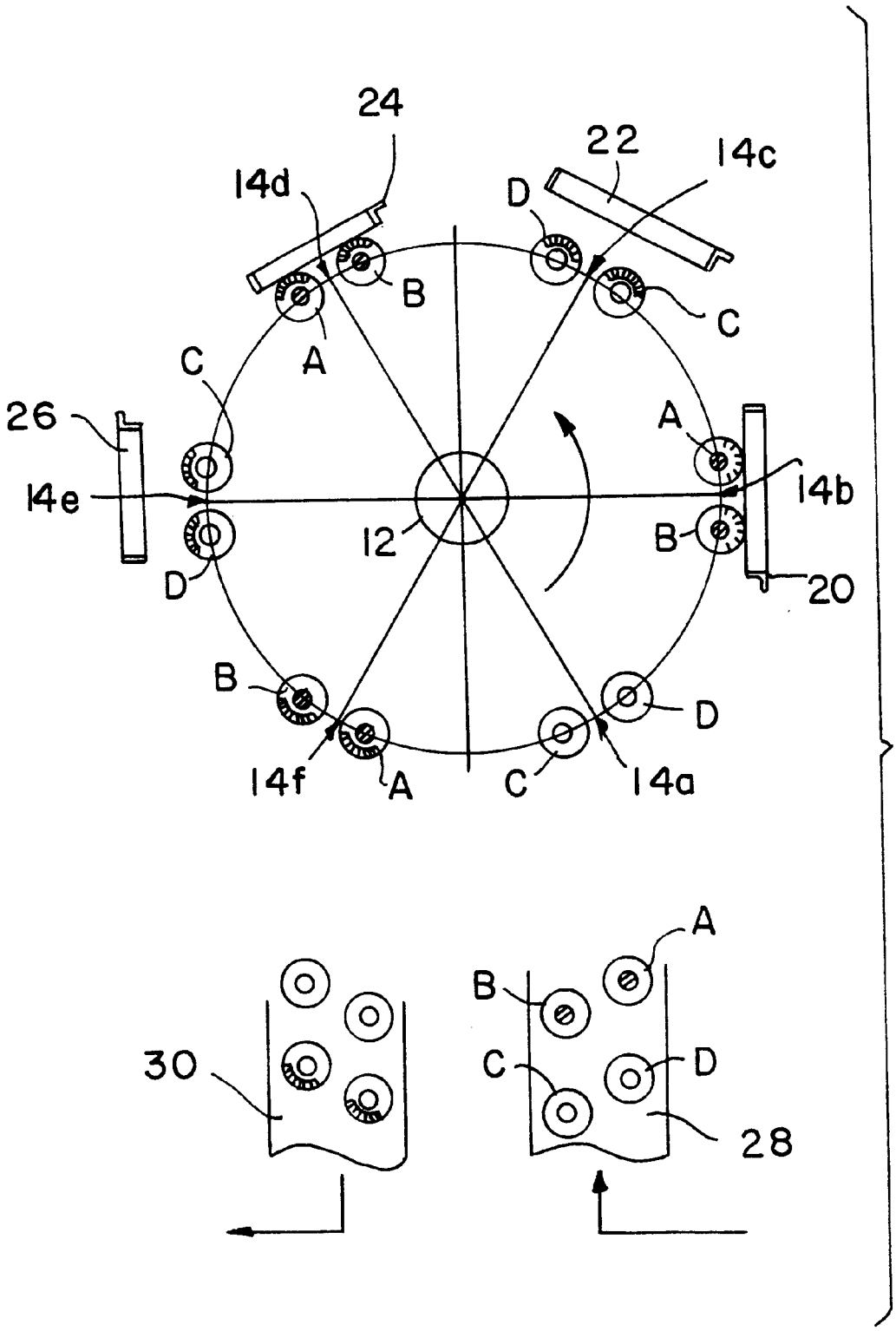
Figure 7A:
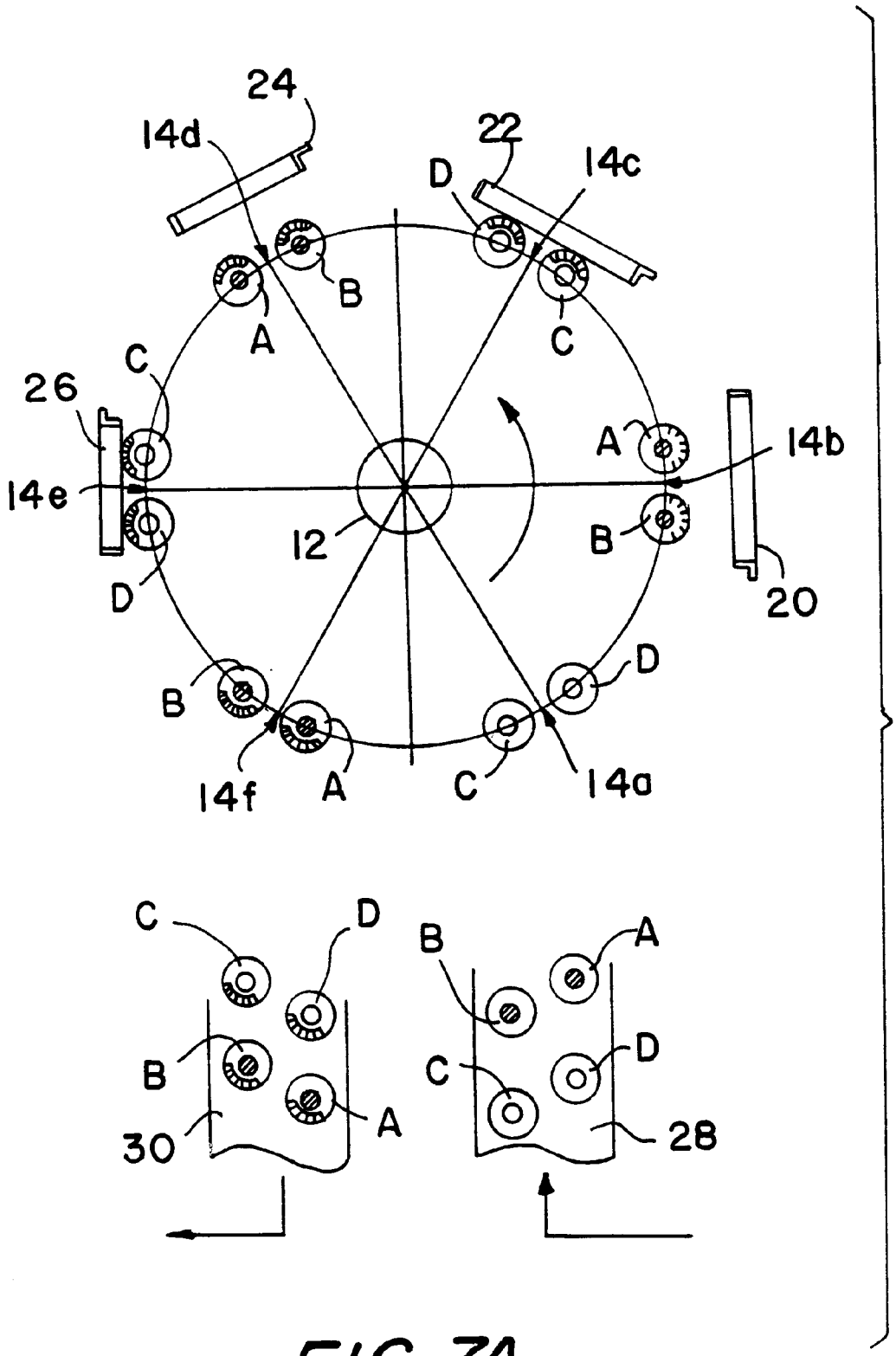

The process of using the machine according to the above mentioned arrangement would be as follows: Receiving two bottles A and B from the belt conveyor 28, which are loaded in the position corresponding to the transporting station 14*a,* bottles A and B are carried with an intermittent movement toward positions: 14*b* and 14*d,* where decorating screens 20 and 24 have a transverse movement (making contact with the bottles) while, at positions 14*c* and 14*e,* screens 22 and 26 are kept stationary outside contact with the surface of bottles A and B. In the position 14*b,* the first color is applied simultaneously to bottles A and B and, a second color is applied in the station 14*d* (FIG. 7). When a second pair of bottles C and D are fed (different configuration and size), screens 20 and 24 make a transverse movement outward to avoid contact with bottles C and D, while screens 22 and 24 set up on stations 14*c* and 14*e* are moved transversely inward to apply a different decoration on the surface of bottles C and D (FIG. 7A). Such alternating movement of the screens may be used to modify the number of colors applied on the bottles.

In a continuous process of decoration, two or more bottles A and B will be decorated simultaneously in stations 14*b* and 14*d,* and two or more bottles of different configuration C and D or with a different decoration pattern will be decorated in stations 14*c* and 14*e.* All the bottles will be unloaded in a position corresponding to station 14*f.*

Notwithstanding the above, even when a decorating machine that decorates the bottles in a horizontal position has been described, it is possible to modify the structure of the machine in such a way that bottles A and B may be fed in a vertical position, that is, the rotatable shaft would be in a vertical position and the transporting stations 14 will move the bottles in a vertical position. In this case, the supporting member 16 would support the base of the bottles and the supporting member 18 would support the neck or the mouth of such bottle by its upper part. The decorating screens 20, 22, 24 and 26 would be in a vertical position coinciding with the surface of each bottle to be decorated.

From the above, the method for the decorating of containers comprises the steps of:

a) feeding a plurality of containers to be decorated from a conveyor toward transporting stations of a decorating machine;

b) loading simultaneously at least two containers for each one of the transporting stations (14, 14') of said machine, said transporting stations (14, 14') including at least two holding means (17, 17*a*) for each one of the supporting members (16), for holding the bottom of at least two containers (A, B); and, at least two holding means (19, 19*a*) for each one of the supporting members (18), for holding the neck of said at least two containers (A, B), said holding means being arranged symmetrically in order that at least said two containers can be printed;

c) rotating the transporting stations with an intermittent movement, making the bottles to coincide with a decorating screen provided for each printing stop station of the decorating machine;

d) decorating at least two containers with a printer screen (PD) for each transporting station, each printer screen (PD) being adjusted parallel or angularly with respect to the surface of the containers (A, B) in order to decorate simultaneously at least said two containers during each printing stage, each container being rotated over its own axis in order to be decorated by each decorating screen; and, e) unloading said at least two containers recently decorated from the transporting stations to said conveyor.

A method for the decoration of bottles or similar articles is disclosed above in which the stage of simultaneous decoration of bottles comprises: decorating at least two bottles with three different decorating screens.

A method for the decoration of bottles or similar articles is disclosed above where the stage of simultaneous decorating of bottles comprises: decorating at least two bottles with four different decorating screens.

A method for the decoration of bottles or similar articles is disclosed above in which the simultaneous decorating stage also comprises: decorating at least one bottle with four different decorating screens.

A method for the decoration of bottles or similar articles is disclosed above where the stage of simultaneous decoration of at least two bottles comprises: alternating the movement of the screens with a lateral movement, forward to make contact with the surface of the bottle and backwards outside the reach of the bottle in order to modify the number of colors applied on the bottles.

As can be seen from the embodiments described above, a method and a machine for the decoration of containers of similar articles has been described and illustrated that increases the productivity and the number of colors that can be printed in decorating machines. Nevertheless it shall be understood that the invention shall not be limited to the embodiments above described and it will be apparent to the expert in the field that other diverse arrangements can be implemented such as a greater number of stations on the decorating machine as well as an alternative execution that shall be clearly contained within the spirit and scope of the invention that is claimed in the following claims.

We claim:

1. A machine for decorating containers or similar articles comprising:

a supporting structure;

a rotatable shaft coupled in the supporting structure, to rotate over its own axis with an intermittent movement;

a first plurality of transporting stations and a second plurality of transporting stations, said stations being arranged in coincidence one in front to the other and having a predetermined distance therebetween, said first and second transporting stations being connected to said shaft to rotate together with said rotatable shaft;

driving means connected to the rotatable shaft, said rotatable shaft and said first and second transporting stations being rotated together by means of the driving means; and, screen printers respectively located for defining at least two printing stop stations located in the same plane as the surface of the container to be decorated, each printer screen being located between each first plurality of transporting stations and each second plurality of transporting stations, each screen printer being adapted to be alternately positioned so that it decorates the surface of the container to be decorated or so that it does not decorate the surface of the container to be decorated, the improvements characterized by comprising:

at least two first holding means for each one of the first plurality of transporting stations, for holding the bottom of at least two containers; and, at least two second holding means for each one of the second plurality of transporting stations, for holding the neck of at least two containers, said first and second holding means being arranged symmetrically in a position one in front of the other, said first and second holding means being adapted to receive, support and release the container from a loading position to an unloading position of the machine;

said screen printers including structure to allow printing on one or more of said at least two containers, said printing comprising at least two decorating impressions within less than one complete revolution of the first and second plurality of transporting stations, each of said at least two decorating impressions being received at a different one, of said at least two printing stop stations than the remainder of said at least two decorating impressions, the screen printers being adapted to allow at least two containers selected from said at least two containers to each receive a decorating impression simultaneously at one or more of said at least two printing stop stations, the screen printers being further adapted to allow one container selected from said at least two containers to receive a decorating impression at one or more of said at least two printing stop stations, the screen printers being further adapted to allow one or more containers selected from said at least two containers to receive a decorating impression at one or more of said at least two printing stop stations.

2. A method for decorating containers comprising the steps of:

a) feeding a plurality of containers to be decorated from a conveyor toward transporting stations of a decorating machine;

loading simultaneously at least two containers between a first plurality of transporting stations and a second plurality of transporting stations, said stations having a predetermined distance therebetween, each first plurality of transporting stations including at least two first holding means for each one of the first plurality of transporting stations, for holding the bottom of at least two containers, and each one of the second plurality of transporting stations including at least two second holding means for each one of the second supporting members, for holding the neck of at least said two containers, said first and second holding means being arranged symmetrically in order that at least two containers be simultaneously printed with a single printer screen;

c) rotating the transporting stations with an intermittent movement, making the containers to coincide with a screen printer provided for each of at least two printing stop stations of the decorating machine, each screen printer being adapted to be alternately positioned so that it decorates the surface of a container to be decorated or so that it does not decorate the surface of a container to be decorated;

d) decorating one or more of said at least two containers with a printer screen for each transporting station, each printer screen being adjusted in accordance with the surface of the containers to be printed, each container being rotated over its own axis in order to be decorated by each printer screen, each container receiving at least two decorating impressions from at least two of said screen printer, each of said at least two decorating impressions being received at a different one of said at least two printing stop stations than the remainder of said at least two decorating impressions, the screen printers being adapted to allow at least two containers selected from said at least two containers to each receive a decorating impression simultaneously at one or more of said at least two printing stop stations; and, e) unloading said at least two containers recently decorated from the transporting stations to said conveyor after less than one full rotation of the transporting stations between said loading and said unloading of said at least two containers.

* * * * *